United States Patent [19]

Duffy

[11] Patent Number: 4,939,649

[45] Date of Patent: Jul. 3, 1990

[54] METHOD OF CORRECTING NONUNIMODALITY OF DIPMETER TRACES BY UNIQUELY TRANSFORMING INDIVIDUAL TRACES OR INTERVALS

[75] Inventor: John A. Duffy, Broken Arrow, Okla.

[73] Assignee: Amoco Corporation, Chicago, Ill.

[21] Appl. No.: 226,353

[22] Filed: Jul. 29, 1988

[51] Int. Cl.[5] ..... G01V 3/08

[52] U.S. Cl. ..... 364/422; 324/333

[58] Field of Search ..... 364/421–422; 324/333

[56] References Cited

U.S. PATENT DOCUMENTS

| | | | |
|---|---|---|---|
| 4,303,975 | 12/1981 | Hepp | 364/422 |
| 4,316,250 | 2/1982 | Vincent | 364/422 |
| 4,320,469 | 3/1982 | Frawley et al. | 364/422 |
| 4,348,748 | 9/1982 | Clavier et al. | 364/422 |
| 4,357,660 | 11/1982 | Hepp | 364/422 |
| 4,541,275 | 9/1985 | Kerzner | 364/422 |
| 4,715,021 | 12/1987 | Dittert | 364/421 |
| 4,852,005 | 7/1989 | Hepp et al. | 364/422 |

OTHER PUBLICATIONS

"Correlation", pp. 91–108.

"Considerations of the Place of Assumptions in Correlational Analysis", by Arnold Binder, pp. 338–349.

"A Computer Program for Determining Optimal Data Transformations Minimizing Skew," by William P. Dunlap and John A. Duffy, Behav. Res. Meth. & Instru., 1974, vol. 6(1), pp. 46–48.

*Primary Examiner*—Jerry Smith

*Assistant Examiner*—Gail O. Hayes

*Attorney, Agent, or Firm*—Gary M. Bond; Fred E. Hook

[57] ABSTRACT

A set of dipmeter data comprising monunimodal-symmetric datasets is processed prior to correlation and dip computation and display by transforming the nonunimodal-symmetric datasets into unimodal-symmetric datasets while maintaining the subsets which are already unimodal-symmetric.

6 Claims, 8 Drawing Sheets

FAMILY OF TRANSFORMATIONS $$Y = \frac{X^{\lambda}-1}{\lambda}$$

$\lambda = -1$ Reciprocal Transformation
$\lambda = 0$ Logarithmic Transformation
$\lambda = 1/2$ Square Root Transformation
$\lambda = 1$ Linear Transformation

MEASURE OF SKEW $$DM3 = \Sigma \frac{(Y-Y)^3 N}{(N-1)(N-2) S^3}$$

METHOD OF CORRECTING NONUNIMODALITY OF DIPMETER TRACES BY UNIQUELY TRANSFORMING INDIVIDUAL TRACES OR INTERVALS

FIELD OF THE INVENTION

The invention relates to the exploration for natural resources such as oil and gas by processing dipmeter well logs. In a particular aspect, the invention relates to processing dipmeter well logs, and more particularly, to an improved technique for preprocessing dipmeter well log data which can then be used in automatically computing dip angle (dip) and dip direction (azimuth) of subterranean formations intersecting a borehole.

SETTING OF THE INVENTION

In dipmeter processing techniques using "automatic correlation," a data processor performs both a function of recognizing or correlating features on different dipmeter traces and a function of calculating dip angles based on the significantly correlated events.

A typical method of automatic correlation proceeds by comparing a segment of a reference trace (the correlation interval) with a plurality of mutually overlapping correlation intervals of other trace(s) along a search segment starting above and ending below the reference trace correlation interval, and by generating a correlation factor or measure of agreement for each comparison. Then the reference correlation interval is stepped along the reference trace and the round is repeated.

Program's for performing such correlations typically require specification of a correlation interval (the length of each trace to be compared and correlated at each round of correlations), of a step distance (the depth increment that the correlation is moved between two successive rounds of correlation) and the search length (how far along the depth scale the data processor will hunt for correlations before stopping and turning to another pair of traces).

One commonly used technique for correlating dipmeter data uses the Pearson Product Moment Correlation. According to this procedure, any of the traces can be selected as the reference trace and correlated with another trace (the search trace) so long as the processor is provided data from which can be determined the exact location of the electrode system associated with the reference trace.

Most statistical matching procedures used in dipmeter processing, including the Pearson Product Moment Correlation, are based on the assumption that the data being processed have a normal distribution. In practice, the Pearson Product Moment Correlation works quite satisfactorily so long as the data distribution is approximately symmetrical and unimodal.

As described in the Example below, data having nonunimodal-symmetric distributions have been found to produce unreliable results when dips are determined from highly correlated events selected, for example, using the Pearson Product moment Correlation.

Dipmeter trace data can fail to be unimodal-symmetric because of the particular dipmeter logging system used in obtaining the data, because of subsequent processing of the data, or because of formation characteristics.

Older dipmeter systems generally recorded sample values in arbitrary units and the resulting trace data were generally unimodal-symmetric in distribution.

New dipmeter logging systems often record values in resistivity or conductivity and frequently have a logarithmic distribution.

Vendors of dipmeter logging services who know the typical logging characteristics of their own logging system sometimes apply corrective transformations uniformly to the data prior to providing data to a user, with the goal of making the transformed datasets typically unimodal-symmetric. The purchaser of such data may or may not be aware of such data transformations.

It has also been found that even for a particular dipmeter logging system, certain intervals of certain traces can have nonunimodal-symmetric data distributions even though other intervals of the same trace are unimodal-symmetric. This can occur, for example, where mineral impregnation has resulted in similar resistivity/conductivity values across bedding planes and other subterranean structures throughout the interval, where one or more of the electrode pads has had intermittently poor contact with the formation during logging and the like.

As described in the Example below, it has also been found that a data transformation applied to all traces uniformly is less effective than data transformations specially selected for and applied to each trace individually and separately. These differences among traces can result from tool characteristics which can vary for the different pads, from differing pressures applying the pads to the formation, from differing mudcake thickness adjacent the pads, and from other factors and transient conditions which differently affect the resulting traces.

Where the vendor of the dipmeter data applies a transformation based on tool characteristics uniformly to all of the traces, the transformation will of course transform nonunimodal-symmetric distributions into unimodal-symmetric distributions. However, some data distributions resist transformation into a generally unimodal-symmetric distribution. Moreover, such uniformly applied transformations will also transform normal distributions into nonunimodal-symmetric distributions.

The user of dipmeter data might require vendors to provide tool and previous transformation information and use this information in determining dipmeter data processing. The purchaser might then predict the distribution of the data provided and apply uniformly a transformation for converting the dataset into a generally normally distributed dataset. This result also fails to take into account departures from unimodal-symmetric distributions occurring in particular traces or in particular intervals of particular traces of a well. The prior art thus approaches the problem in a priori manner, first predicting what the usual distribution of a dataset will be, then uniformly applying a transformation.

From the user's perspective, these approaches create an administrative burden and produce unreliable and incorrect results which by the nature of dipmeter analysis are often difficult to detect.

SUMMARY OF THE INVENTION

In accordance with the invention, there is provided a method for preprocessing dipmeter traces for correlation, dip computation, and display of dip angle and direction of structural features intersecting a borehole. The method comprises transforming data in a first trace using transformation(s) selected for the first trace and transforming data in a second trace using transformation(s) selected for the second trace. The transformation(s) selected for the first trace differ from transformation(s) selected for the second trace and the transformed first trace and second trace are characterized by an improved symmetry of data distribution relative to the first and second traces prior to such transformations.

According to a further aspect of the invention, the transformation(s) are selected for, and the transformed first and second traces are characterized by, improved unimodality of data distribution(s) relative to the first and second traces prior to such transformations.

According to a further aspect of the invention, the step of transforming data in a first trace comprises scanning the first trace for intervals having data distributions which are not generally symmetric and/or unimodal and transforming said intervals to provide data distributions which have said improved symmetry and/or unimodality; and the step of transforming data in a second trace comprises scanning the second trace for intervals having data distributions which are not generally symmetric and/or unimodal and transforming said intervals to provide data distributions which have said improved symmetry and/or unimodality.

According to a further aspect, structural disinformation is removed from trace(s) prior to such transformation being applied.

According to a further aspect of the invention, the step of transforming data in a first trace comprises: scanning the first trace for interval(s) having data distribution(s) which are not generally unimodal-symmetric; resolving such interval(s) into further subpopulations; and transforming such further subpopulations to provide resulting data distribution(s) which have improved symmetry or unimodality relative to the subpopulations prior to such transformations. The step of transforming data in a second trace likewise comprises scanning the second trace for interval(s) having data distribution(s) which are not generally unimodal-symmetric; resolving such interval(s) into further subpopulations, and transforming such further subpopulations to provide resulting data distribution(s) which have improved symmetry or unimodality relative to the subpopulations prior to such transformations.

DEFINITIONS

Apparent Dip—The slope of a geologic feature relative to a plane defined by three or more dipmeter electrodes.

Bedding Plane—In sedimentary or stratified rocks, the division plane that separates each successive layer or bed from the one above or below it, commonly characterized by a visible change in color or lithology or resistivity/conductivity.

Borehole Deviation—The divergence or deflection from the vertical of a borehole; sometimes referred to as inclination.

Borehole Deviation Direction—The horizontal angle relative to magnetic north of borehole deviation; also referred to as azimuth of borehole deviation; essentially the same as Direction of Hole Drift (DHD).

Dip Angle—The inclination from horizontal of the line on an inclined plane of greatest inclination from horizontal; perpendicular to strike; sometimes referred to as dip or dip magnitude or slope.

Dip Direction—The horizontal angle relative to magnetic north of the projection onto the horizontal plane on the line of an inclined plane of greatest inclination from horizontal; sometimes referred to as azimuth of dip.

Displacement—The vertical distance in the borehole between equivalent responses measured by different electrode systems of a dipmeter.

Structural disinformation—data along a trace which are irrelevant to an aspect of subterranean structure under evaluation. As such, structural disinformation can be due to noise, intermittent contact of an electrode with a formation, local geologic events such as fractures and drilling artifacts, and the like.

Tool Azimuth—Clockwise angle from magnetic north to a selected reference electrode, also sometimes referred to as Azimuth of Reference Electrode or Relative Bearing.

DETAILED DESCRIPTION OF THE INVENTION

Figure 1:
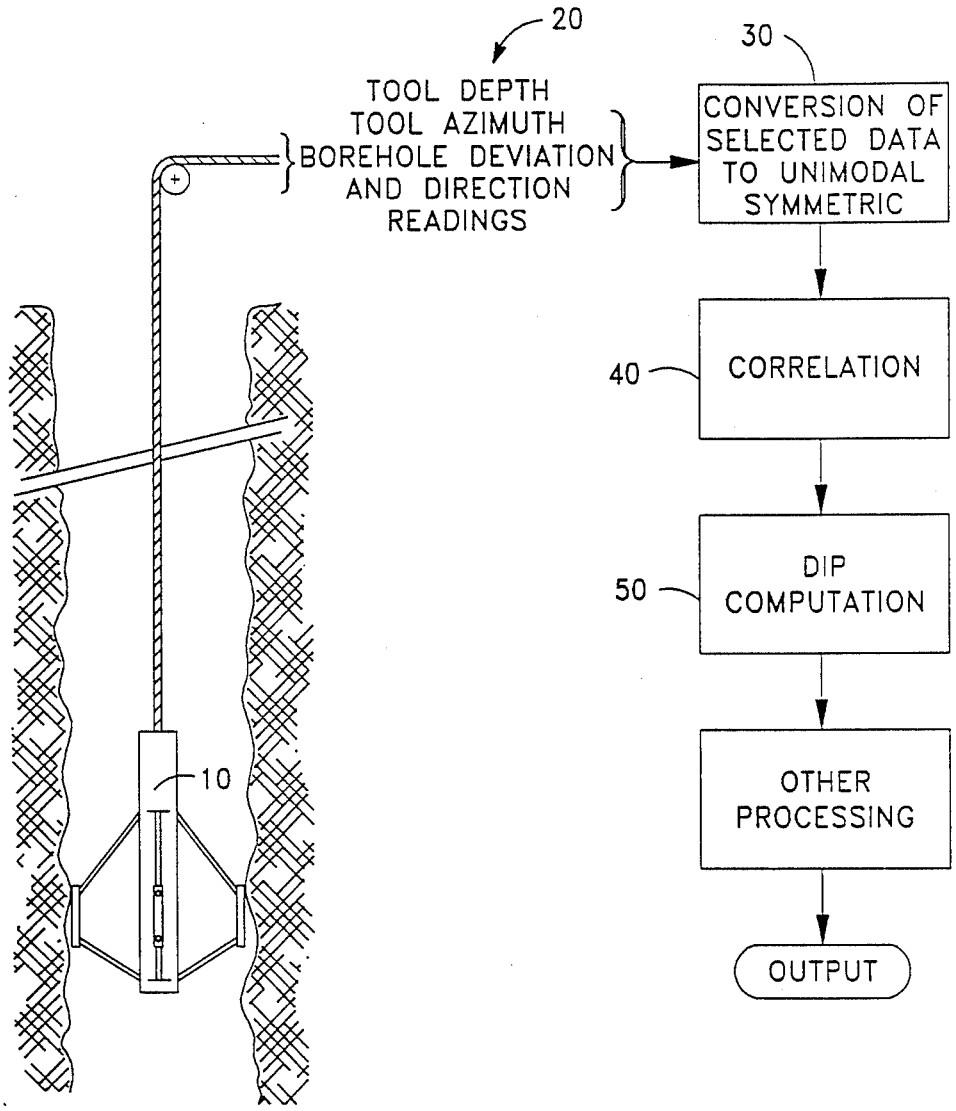
FIG. 1 illustrates a dipmeter tool suspended in a borehole and a block diagram of a processing method in accordance with the invention.

FIG. 1 illustrates a dipmeter logging tool 10 measuring formation conductivity or resistivity adjacent a borehole by three or more directionally focussed electrode systems in contact with the formation. As the dipmeter tool 10 is moved along the borehole, many measurements or readings, typically 60–120 per foot, are taken. A trace is recorded for each electrode system by recording readings preferably in digital form as a function of depth. In addition to traces, tool depth, tool azimuth, and borehole deviation and deviation direction data are also obtained. Such information is illustrated generally by reference numeral 20.

In accordance with the invention, data of one or more traces which initially do not have a generally unimodal-symmetrical data distribution are transformed by transformations specially adapted for each trace, and even for specific intervals along each trace, to give data distribution(s) which are generally unimodal-symmetrical. This special transformation step is illustrated by reference numeral 30 and is discussed in more detail below in connection with FIGS. 4, 5, and 6.

The traces which have been transformed on a trace-by-trace and even interval-by-interval basis to provide generally unimodal-symmetric data distributions in accordance with the invention are then correlated, for example, by correlation step 40, discussed below in more detail in connection with FIGS. 2A, 2B, 2C, and 3.

Since each structurally informative feature on a trace is the signature of a geologic event such as a bedding plane in the depositional sequence traversed by the dipmeter in the borehole, if the same event can be correlated in three or more traces, then by measuring the displacements of the event between pairs of traces and applying trigonometry, the apparent dip angle of that feature can be determined. Knowing the borehole deviation nd direction and the tool azimuth, the true dip of the feature relative to horizontal and to magnetic north can be determined. This step is illustrated by reference numeral 50.

After further processing, illustrated by reference numeral 60, various outputs 70 are generated, for example, computer files, hardcopy outputs, and visual displays of dip angle and direction which can then be used by the explorationist in the search for oil and gas.

Figure 2A:
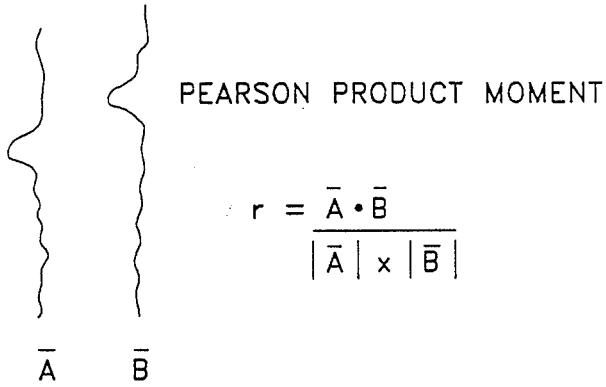
FIG. 2A illustrates two dipmeter traces and the Pearson Product Moment Correlation used to quantitate the correlation between the two traces.

Referring now to FIG. 2A, one commonly used technique for correlating dipmeter data uses the Pearson Product Moment Correlation. According to this procedure, one of the traces can be selected as the reference trace and correlated with another trace (the search trace). The data processor is provided data from which can be determined the exact location of the electrode system associated with the reference trace. Such data includes tool depth, tool azimuth, and borehole deviation and direction.

Figure 2B:
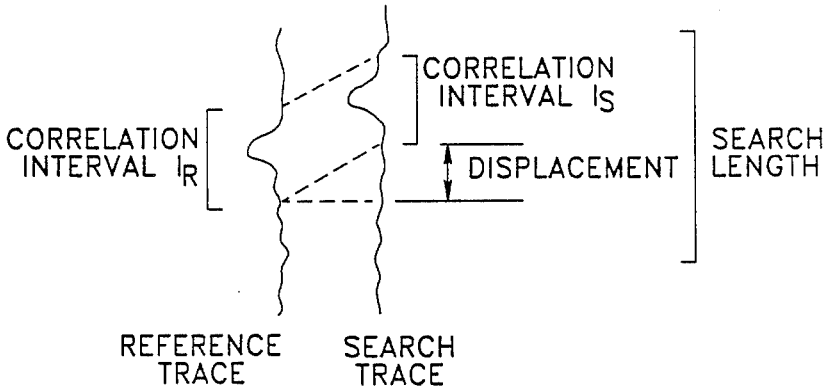
FIG. 2B illustrates two dipmeter traces showing the correlation interval $I_R$ and $I_s$ on reference and search traces and the search length, as well as illustrating displacement between highly correlated events on the two traces.

Referring now to FIG. 2B, figure illustrates comparing data in a correlation interval $I_R$ of a reference trace with data in one of a plurality of mutually overlapping correlation intervals $I_S$ within a search length on the search trace. For each correlation in a round, two quantities or measures are generated: an "r-value" representative of the goodness of fit of the correlation interval $I_R$ of the reference trace to the correlation interval $I_S$ being evaluated on the search trace; and a corresponding displacement of $I_R$ relative to $I_S$ The process is continued by stepping the interval, i.e., by incrementing the starting depth of $I_S$ across a user-defined search distance L by a user- or default-specified step distance until a full list of r-values and displacements for the mutually overlapping series of $I_S$ are obtained for a selected $I_R$ for all pairs of traces being correlated. Then the starting depth of $I_R$ can be incremented and the round repeated. For a given $I_R$ and a corresponding series of $I_S$, a plot of r-displacements and r-values produces a correlogram such as shown in FIG. 2D.

Figure 2C:
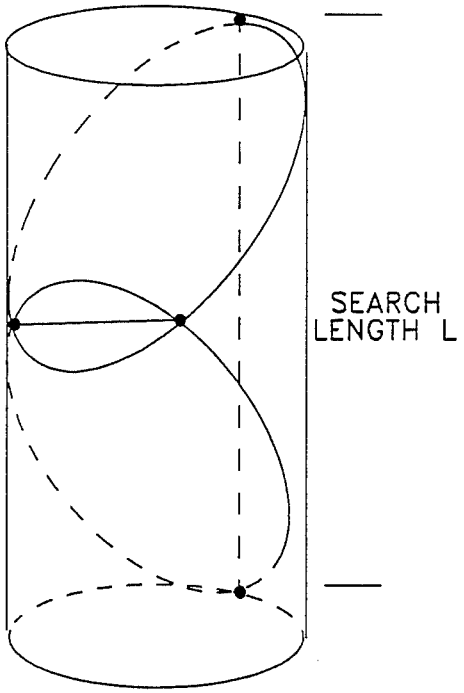
FIGS. 2C & 2D illustrate how search length is related to maximum and minimum expected displacements and how the displacements can be displayed on a correlogram.
Figure 2D:
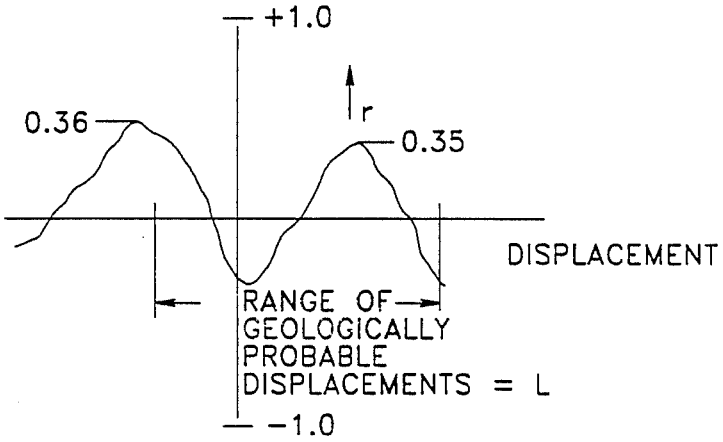

As illustrated in FIG. 2c, the search length L can be selected to cover the minimum and maximum expected displacement of structural features such as bedding planes which can be estimated as is well known in the art. Generally, the search length can be from about 1 ft to about 6 ft.

The r-values on the correlogram can vary between $-1.0$ and $+1.0$ and typically, the correlogram exhibits at least one and frequently more than one peak over the search length. Only positive values are considered. If the data values of $I_R$ are identical to the data values in $I_S$, the r-value reaches exactly 1.0 at the true displacement of the corresponding geologic feature on the traces. For any other displacement, the r-value is less. If the search trace displays a periodic pattern, the value of 1.0 can occur repeatedly at displacements corresponding to the period of the search trace. If as is typically the case, one or more of the curves is perturbed by noise, the correlation value may not reach 1.0 or may reach 1.0 at another displacement. As indicated, the correlogram can and most frequently does exhibit more than one peak.

The procedure illustrated by FIG. 2 is known to those skilled in dipmeter processing and need not be described further here.

Typically, the correlation process involves determining the displacements as a function of depth along the borehole between two traces for the highly correlated events. These significantly correlated displacements can be generated, for example, from the three highest correlation values (three largest peaks on the correlogram) to provide a redundancy of displacement data for further processing. Traces are correlated two traces at a time as selected by the user or by default specification.

Figure 3:
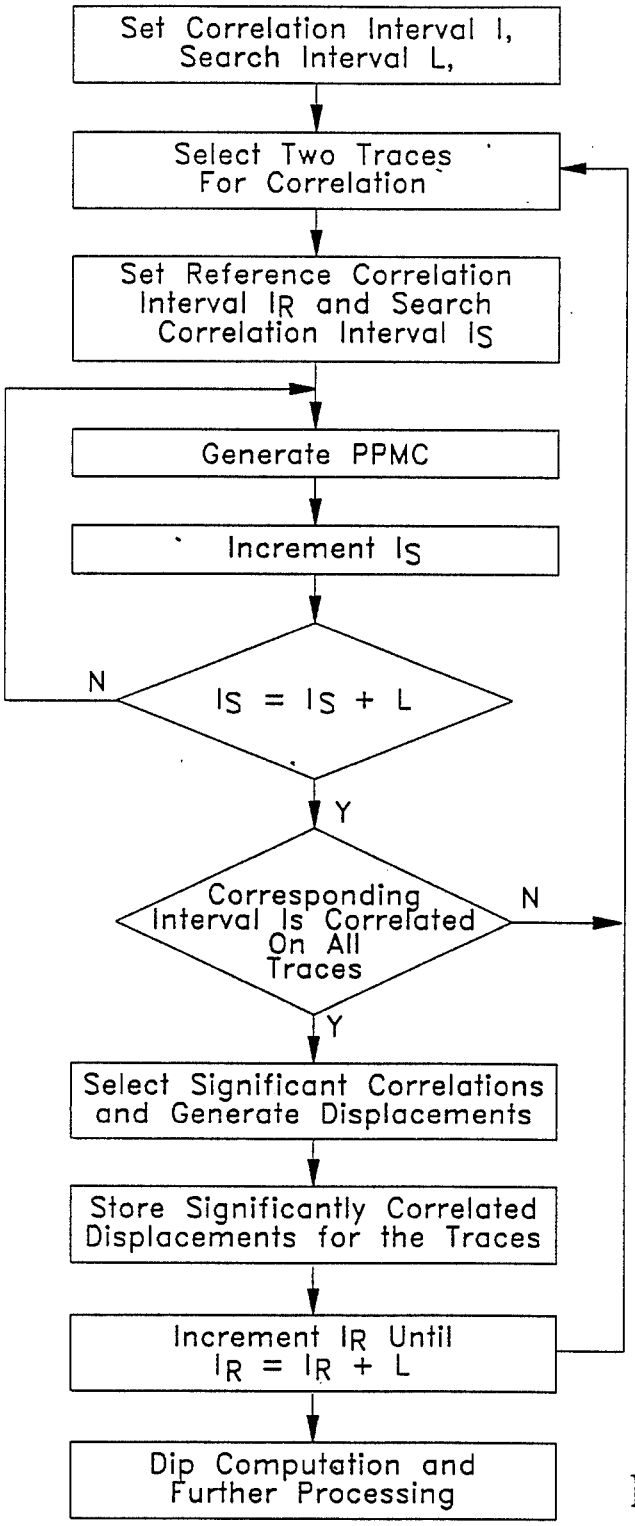
FIG. 3 illustrates a known correlation procedure.

Referring now to FIG. 3, FIG. 3 illustrates a correlation process to which can be provided data transformed in accordance with the invention. As shown in FIG. 3, after setting the correlation interval I and the search interval L, two traces are selected for correlation. The correlation interval is set on the two traces.

Then the Pearson Production Moment Correlation (PPMC) values for the initial correlation interval on the reference trace $I_R$ relative to a mutually overlapping series of $I_S$ on the search trace are generated. Thus, $I_S$ is stepped along the search trace, that is, the initial depth of $I_S$ is incremented, keeping the same correlation interval, and the process is repeated until the initial starting point of $I_S$ is equal to the initial starting point plus the search length.

Then, another pair of traces is selected for the corresponding interval and the sequence is repeated Such repetition continues until the corresponding interval has been correlated on all desired pairs of traces.

The significant correlations are then selected and the displacements between the significantly correlated events are selected and stored for each pair of traces under evaluation.

At this point, $I_R$ is stepped along the reference trace, that is, the initial depth of $I_R$ is incremented keeping the same correlation interval, and the process repeated. The incrementing of the $I_R$ initial depth can be repeated until $I_R$ equals $I_R$ plus the search length L.

The resulting sets of significantly correlated displacements for the correlated traces can then be provided to dip computation and further processing as is known in the art. See FIG. 1.

Figure 4A:
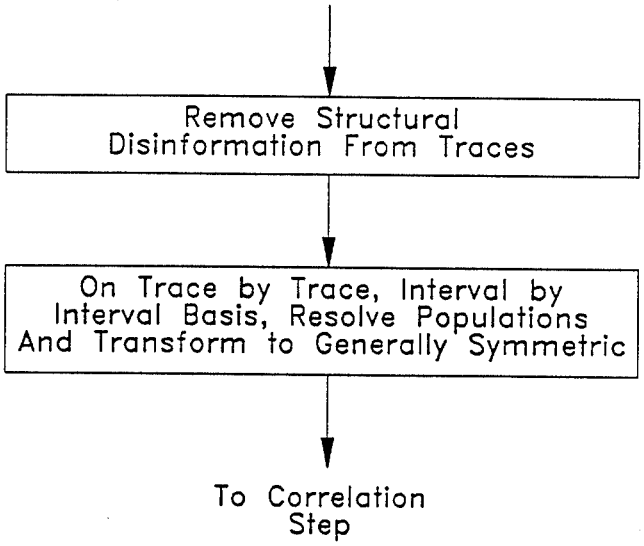
FIG. 4A illustrates broadly a method in accordance with the invention.

Referring now to FIG. 4A, FIG. 4 illustrates broadly a method of trace-by-trace normalization in accordance with the invention.

As illustrated in FIG. 4A, a selected set of traces is edited to remove data subpopluations which are structurally disinformative or misleading. Such editing can use techniques and skills known to those skilled in the art of log editing and need not be elaborated on here.

According to the invention, the edited traces are then scanned or examined on a trace by trace or even interval by interval basis to identify data subpopulations which are not generally unimodal-symmetric in distribution.

The examination can proceed either interactively or be automatically implemented by a data processor.

For example, data populations on a trace can be examined on a whole trace basis or on an interval by interval basis within a trace, for example, by generating a histogram showing the data distribution for a selected population. In instances where, for example, the formations are heterogeneous, examination of each of the traces on an interval by interval basis will be advantageous. In instances, for example, where the formation is more homogeneous across an interval of interest, transformation on a trace by trace basis will be sufficient to provide good results.

Figure 5A:
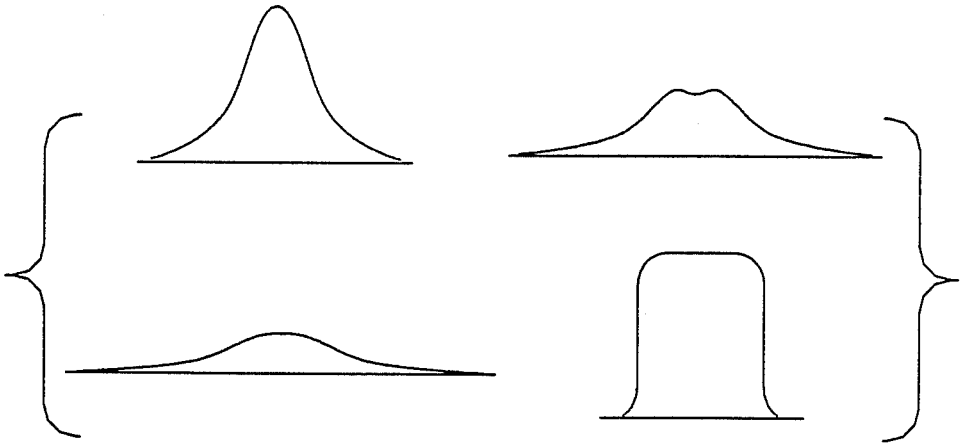
FIG. 5A illustrates generally unimodal-symmetric data distributions.

The interval selected should contain sufficient data to be representative of the distribution of data but not so much data as to clearly result in more than one population of data being considered. Those skilled in the art of statistical processing and log analysis can readily determine whether or not a population can be resolved into more than one subpopulation. Preferably the interval is related to the correlation interval so that the data distribution being evaluated is representative of the data population being provided to the correlation algorithm.

Where the data distribution of the trace, or even of a selected interval on a trace, is generally unimodal-symmetrical, no transformation of the data in the population is necessary. As indicated above, the Pearson Product Moment Correlation is tolerant of departures from normality so long as the data distribution is generally unimodal-symmetric. FIG. 5A illustrates examples of generally unimodal-symmetric data distributions. It can be seen that ever weakly bimodal and only roughly symmetrical distributions are included in term covered by "generally unimodal-symmetric data distributions." It may be desirable, however, where bimodality occurs to resolve a population into further subpopulations, for example, by selecting a shorter interval along the trace for applying the invented method, by deleting information not necessary for evaluation of a structural feature of interest, and the like.

As used herein and in the claims, the concept of transforming a data distribution which is not generally unimodal-symmetric to one which is generally unimodal-symmetric means that the symmetry and preferably the modality of the data distribution are caused to shift so as more closely approximate the normal distribution. The resulting data set preferably having a generally unimodal and symmetric data distribution, when applied to a subsequent correlation step which is based on an assumption of normality, provides an advantageous result in resolving and identifying structural changes along a borehole. The concept of transforming data distributions to achieve a more symmetric and unimodal data distribution will be well understood by those skilled in the art and need not be further described here. Statistical measures of symmetry such as the third moment about the mean, Chi square, and other goodness of the fit tests, and of modality such as a measure of differences between mean, median, and mode can all be used to determine whether or not a transformation in accordance with the invention has been accomplished. The incontrovertible test of such transformations in accordance with the invention will be increased resolution of structural features apparent in the displays of dip angle and direction on dipmeter plots after processing in accordance with the invention.

Transformation of the data sets to a more unimodal-symmetric distribution can frequently be accomplished using a standard library of transformations such as $$x' = \log x$$

$$x' = \sqrt{x}$$

$$x' = x^2$$

$$x' = \log e^x$$

and the like where x and x' are a datum before and after transformation respectively. Such transformations can be illustrated schematically by $T_1$, $T_2$, $T_3$ in FIG. 5B. It will be appreciated that the desired result in accordance with the invention is not necessarily a normal or Gaussian distribution of the data but an improvement in symmetry and unimodality relative to the initial distribution. As indicated above, this improvement can be quantitated or objectified using standard statistical measures or by the improved dipmeter displays resulting from processing in accordance with the invention.

Where a standard transformation is not effective for producing a more unimodal-symmetric distribution, a nonstandard transformation which effectively transforms the data can be selected. For example, an algorithm such as that illustrated in FIG. 6 can be used. The algorithm $$y = \frac{x^\lambda - 1}{\lambda}$$

yields a family cf transformations depending on the value of λ. A suitable λ can be estimated for a given dataset by using the third moment about the mean DM3

$$DM3 = \Sigma \frac{(y - \bar{y})^3 N}{(N-1)(N-2) S^3}$$

where y is a data point, $\bar{y}$ is the mean of the data points y in the population, N is size of the population and S is the standard deviation of the population.

Figure 6:
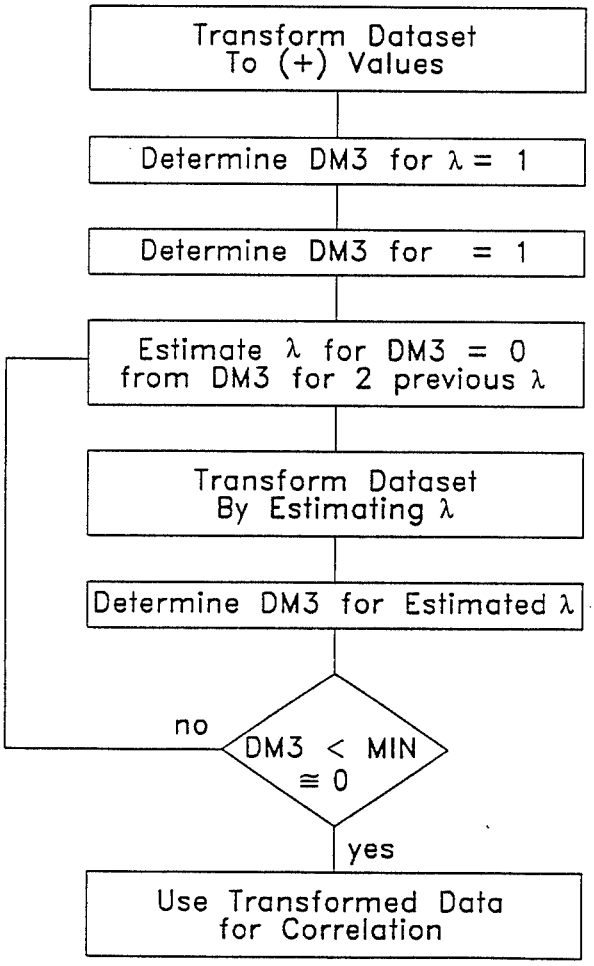
FIG. 6 illustrates a method of selecting an effective transformation for transforming data into generally unimodal-symmetric data distributions.

As indicated in FIG. 6, the value of λ where DM3 =0 can be initially estimated from values of DM3 for λ=0, λ=1. Then the resulting value of λ can be used to estimate the next value of λ until the third moment DM3 is less than a selected minimum and approximately equal to zero. The minimum can be selected to any desired low value, but lower values will require more iterations of the algorithm. This algorithm is fully described in Dunlap and Duffy, "A Computer Program for Determining Optimal Data Transformation Minimizing Skew,"6 Behav. Res. Meth. and Instru. 46–48 (1974) and need not be further described here.

Other methods of generating transformations can also be used, including trial and error method, and this step therefore requires no further description.

Clearly, it will be advantageous to save an effective transformation once it has been found since it will likely be effective for other traces in the same borehole and for other intervals in the same trace. In this way a library of dipmeter transforms specially selected for dipmeter data can be generated and transforms can be selected using λ and a table of transformations indexed by values of λ.

Figure 4B:
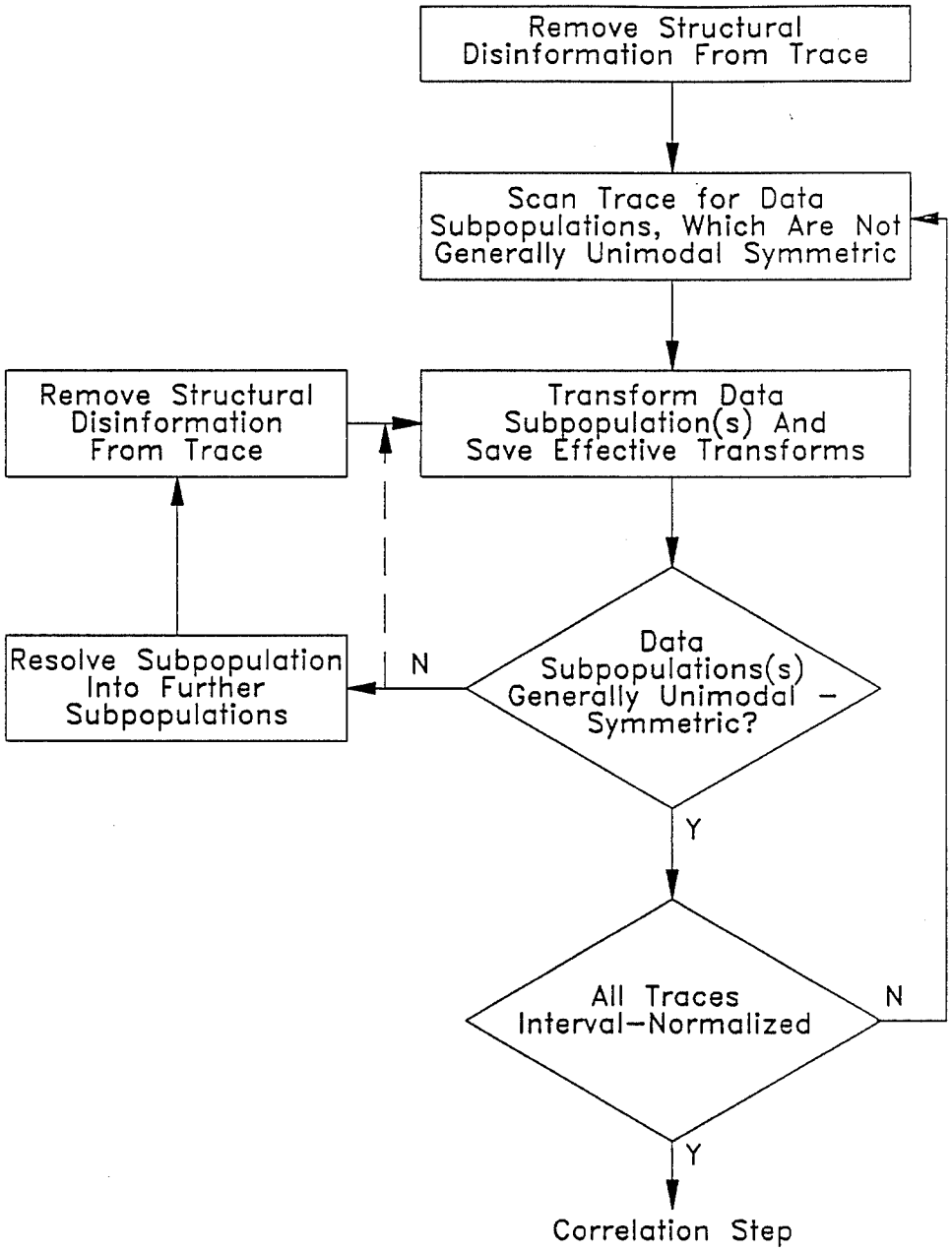
FIG. 4B more specifically illustrates a method in accordance with the invention.
Figure 5B:
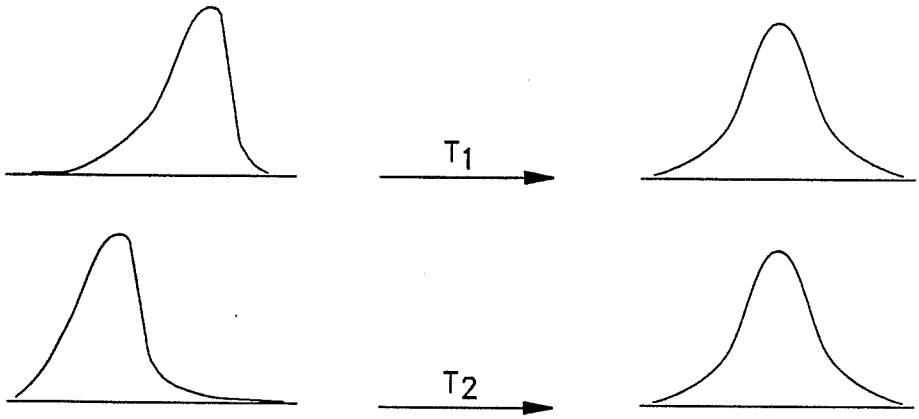
FIG. 5B illustrates unimodal asymmetric data distributions which can be transformed into generally unimodal-symmetric data distributions.
Figure 5C:
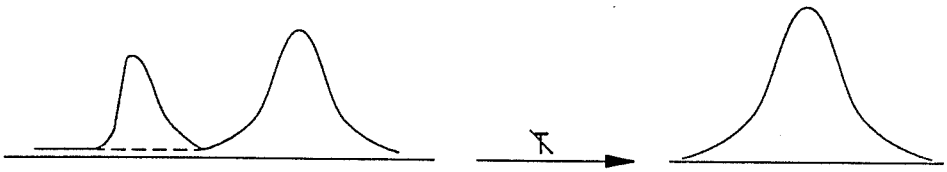
FIG. 5C illustrates a bimodal asymmetric data distribution which resists transformation into a generally unimodal-symmetric/data distribution.

Referring now to FIG. 4B, FIG. 4B illustrates a specific embodiment of a method in accordance with the invention for improving the generally symmetrical unimodal character of data distributions in a trace on an interval by interval basis.

As discussed in connection with FIG. 4A, the first step is editing of the trace to remove structural disinformation followed by scanning of the trace to identify data subpopulations which are not generally unimodal-symmetric. Transformations are generated and applied as described above.

For each transformation, the data distribution can be evaluated to determine whether the distribution is now generally unimodal-symmetrical. If not, another transformation can be applied and tested as illustrated by the dashed loop in FIG. 4.

It can happen that one or more traces or one or more intervals on a trace have a data distribution for which no fully satisfactory transformation can be found. Such a situation is illustrated schematically in FIG. 5C. Such difficult to normalize intervals are frequently found in strongly bimodal asymmetric data distributions and can indicate that two, or more, populations of data are being treated as one.

When such difficult to normalize intervals are encountered, it may be possible to resolve the population in the interval into two or more subpopulations of data which can be individually transformed to a satisfactorily unimodal-symmetric distribution. Alternately, for example, where the interval contains data which is not informative of an aspect of structure under investigation, for example, data due to fractures where bedding planes are of primary interest, one of the populations can be simply removed as illustrated schematically by the dashed line in FIG. 5C.

In yet other cases, it will be undesirable to remove data since the data will provide information about structural changes. In such event, the most effective transform identified will be applied and, after all traces have been interval normalized, provided to the correlation and dip computation steps.

The invention will be further understood and appreciated from the following examples.

Illustrative Example

This example using synthetic data illustrates that choice of transformation influences the value of the Pearson Product Moment Correlation. A set of data x is transformed as indicated by the following Table; and means, standard deviations, z scores and Pearson Product Moment Correlation values are determined for correlating the original data set with a selected transformed dataset.

Z-scores are calculated by $$Z_x = \frac{(x - \bar{x})}{S.D.}$$

Where $Z_x$ is the z-score of datum x, $\bar{x}$ is the mean of values x in the dataset, and S.D. is the standard deviation. The Pearson Product Moment Correlation (PPMC) is calculated by $$r_{xu} = O \xrightarrow{\Sigma} N \frac{Z_x Z_u}{N}$$

Where $r_{xu}$ is the PPMC for comparing dataset x to dataset u; $Z_x$ and $Z_u$ are the respective Z-scores for the datasets x and u; and N is the number of paired observations. The results are presented in the following Table:

| | x | $u = 10^x$ | $v = 10^x$ | $w = \log(10^x)$ |
|---|---|---|---|---|
| Data | 1.00 | 10.00 | 10.00 | 1.00 |
| | 2.00 | 20.00 | 100.00 | 2.00 |
| | 2.00 | 20.00 | 100.00 | 2.00 |
| | 3.00 | 30.00 | 1000.00 | 3.00 |
| | 3.00 | 30.00 | 1000.00 | 3.00 |
| | 3.00 | 30.00 | 1000.00 | 3.00 |
| | 3.00 | 30.00 | 1000.00 | 3.00 |
| | 4.00 | 40.00 | 10000.00 | 4.00 |
| | 4.00 | 40.00 | 10000.00 | 4.00 |
| | 5.00 | 50.00 | 100000.00 | 5.00 |
| Mean | 3.00 | 30.00 | 12421.00 | 3.00 |
| S.D. | 1.10 | 10.95 | 29429.91 | 1.10 |
| | Zx | Zu | Zv | Zw |
| Z Score | −1.83 | −1.83 | −0.42 | −1.83 |
| | −0.91 | −0.91 | −0.42 | −0.91 |
| | −0.91 | −0.91 | −0.42 | −0.91 |
| | 0.00 | 0.00 | −0.39 | 0.00 |
| | 0.00 | 0.00 | −0.39 | 0.00 |
| | 0.00 | 0.00 | −0.39 | 0.00 |
| | 0.00 | 0.00 | −0.39 | 0.00 |
| | 0.91 | 0.91 | −0.08 | 0.91 |
| | 0.91 | 0.91 | −0.08 | 0.91 |
| | 1.83 | 1.83 | 2.98 | 1.83 |
| PPMC | $r_{xx}$ | $r_{xu}$ | $r_{xv}$ | $r_{xw}$ |
| | 1.00 | 1.00 | 0.68 | 1.00 |

It will be seen that u is a linear transformation of x and v is a nonlinear (power) transformation of x. To maximize the correlation (PPMC) between datasets x and v, v must be transformed into a symmetric distribution. This is illustrated by which takes the log of column v.

The results of columns 1 and 4, show, as expected, that dataset x correlates perfectly with itself. The results of columns 1 and 2 show, also as expected, that linear transformations correlate perfectly with an original dataset.

Column 3 illustrates that choice of a transformation influences the value of the PPMC. If an improper transform is applied, for example if dataset x is transformed by a power transform, the resulting correlation relative to the original dataset is less than unity.

As applied to dipmeter processing, such lower valued correlations (occurring as a result of improper transforms or as a result of transforms being applied to datasets already in good form) can cause displacement vectors computed based on correlated events to be less accurate, resulting in less accurate displays of dip angle and direction.

Comparison of columns 3 and 4 illustrates that use of the proper transform restores the correlatability relative to x of the dataset v.

It will be appreciated that from examination of column 3 alone, it might be very difficult to predict which specific transformation will produce a data distribution of v which will be highly correlatable with column 1.

It will further be appreciated that transformation of the data in column 3 to generally unimodal-symmetric distribution will improve the correlatibility of column 3 with column 1.

It will further be appreciated from this Example how conversion of datasets generally to generally unimodal-symmetrics can offer significant advantage in achieving accurate correlations between datasets.

EXAMPLE

Six arm dipmeter data over an interval known to be relatively homogeneous from 13,650 to 14,020 feet are visually examined. Data from arms 1, 2, 5 and 6 appear generally similar. Data from arm 3 appears different and apparently random over the interval. Data from arm 4 appears similar to data from arms 1, 2, 5 and 6 over most of the interval, but appears random and lacking in information over the interval 13,660–13,775.

The following sets of data are generated:

Raw Data I: All data from all traces over the interval

Raw Data II: All data from all traces over the interval except data from arm 3 and data from arm 4 over the interval 13,660–13,775.

Edited Data: Raw Data II edited to remove anomalous signals such as spikes, noise, and the like.

Histograms are generated and visually evaluated for whether a transformation have improved the symmetry and unimodality of a data distribution, i.e., has converted the data distribution into a unimodal, preferably generally symmetrical data distribution.

Transformations are applied uniformly to all traces of Raw Data I and Edited Data using the following standard transformations: log, square root, square, and inverse transformations. These resulting sets of data are referred to as uniformly transformed Raw Data I and Uniformly Transformed Edited Data.

Specific trace-by-trace transformations are selected for each trace using the family of transformations:

$$X' = \left[\log\left(\frac{\max + 4 - x}{S.D.}\right)\right]^{\frac{1}{2}}$$

Where x' is the transformed datum, x is the original datum, max is the largest datum on a trace, and S.D. is the standard deviation for a trace. The result is a transformation specially adapted for each trace since the values of x, max, and S.D. are different for the different traces. The result of applying these transformations to Edited Data is referred to herein as Specially Transformed Edited Data.

Standard dipmeter plots showing dip angle and direction of structural features are generated by correlating, dip computing and generating displays of dip angle and direction for Uniformly Transformed Raw Data I, Uniformly Transformed Edited Data, and Specially Transformed Edited Data. Displacement vectors for the Specially Transformed Edited Data are generated in multiplicities of 5 and 15 vectors by correlating each pad of Raw Data II with one of the other pads, and with three of the others pads, respectively.

In addition, standard transformations including log, square root, square and inverse transformations are uniformly applied to the Specially Transformed Edited Data and displays of dip angle and direction are generated for both the 5 and the 15 displacement vector multiplicities.

On displays of Specially Transformed Edited Data, a clear departure from the prevailing structural trend of the interval is observed from about 13,820–13,900 and is especially apparent in the interval 13,860–13,900.

By contrast, the displays of dipmeter data for the Raw Data I and the Transformed Edited Data show no such clear departure from the prevailing structural trend in the interval using the invented method.

It is concluded that Specially Transformed Data result in disclosure of structural features which are substantially or completely obscured where such data is not specially transformed into generally unimodal-symmetric data distributions.

The displays of Specially Transformed Edited Data after application of standard transformations uniformly applied to all of the traces indicates that the structure identified in the interval 13,860–13,900 is still clearly present, but not as clearly coherent as in the Specially Transformed Edited Data dipmeter plots.

These results indicate that uniformly applied transformations have a detrimental effect on data distributions which are generally unimodal-symmetric and constitute further evidence uniformly applying a selected transformation to all traces of a data set.

It will be apparent that the invented method provides advantageous and improved results in dipmeter processing by preprocessing dipmeter data prior to the correlation and generation of visual displays of dip angling and direction. This preprocessing accomplishes an improvement in the unimodal-symmetric character of the data distributions and, since it is applied on a trace-by-trace, and even interval-by-interval basis, does not create the artifact of transforming data distribution which are quite satisfactory to those which are disadvantageous.

The invention has been described and illustrated by specific embodiments to enable those skilled in the art to fully use and benefit from the invention. The invention, however, is not limited to those specific embodiments but by the claims appended hereto.

What is claimed:

1. A method for preprocessing dipmeter traces for subsequent correlation, dip computation, and display of dip angle and direction of structural features intersecting a borehole, the method comprising:

transforming data in a first trace using transformation(s) selected for the first trace;

transforming data in a second trace using transformation(s) selected for the second trace;

wherein the first trace and the second trace are traces in a set of dipmeter traces obtained during one traverse of a dipmeter along a borehole;

wherein the transformation(s) selected for the first trace differ from transformation(s) selected for the second trace; and wherein the thus transformed first trace and second trace are characterized by data distribution(s) having symmetry and optionally modality more closely approximating a normal data distribution relative respectively to the first and second traces prior to transformation.

2. The method of claim 1 wherein the thus transformed first trace and second trace are characterized by data distributions having a modality more closely approximating a normal data distribution.

3. The method of claim 1 wherein the step of transforming data in a first trace comprises scanning the first trace for intervals having data distributions not having generally unimodal-symmetric characteristics of a normal data distribution and transforming said intervals to provide data distributions therein which have symmetry and unimodality more closely approximating a normal data distribution; and wherein the step of transforming data in a second trace comprises scanning the second trace for intervals having data distributions not having generally unimodal-symmetric characteristics of a normal data distribution and transforming said intervals to provide data distributions therein which have symmetry and unimodality more closely approximating a normal distribution.

4. The method of claim 1 further comprising removing structural disinformation from trace(s) prior to such transforming.

5. The method of claim I wherein the step of transforming data in a first trace comprises:

scanning the first trace for interval(s) having a data distribution not having generally unimodal-symmetric characteristics of a normal data distribution;

resolving such intervals into further subpopulations; and transforming such further subpopulations to provide resulting data distribution(s) having symmetry and unimodality more closely approximating a normal data distribution; and wherein the step of transforming data in a second trace comprises scanning the second trace for interval(s) having data distribution(s) not having generally unimodal-symmetric characteristics of a normal data distribution;

resolving such intervals into further subpopulations; and transforming such further subpopulations to provide resulting data distribution(s) having symmetry and unimodality more closely approximating a normal data distribution.

6. The method of claim 1 further comprising:

generating significantly correlated displacement for pairs of traces; and computing and displaying dip angle and direction of formations adjacent the borehole from the significantly correlated displacements.

* * * * *